US010533782B2

(12) United States Patent
Xu et al.

(10) Patent No.: US 10,533,782 B2
(45) Date of Patent: Jan. 14, 2020

(54) REVERSE DEFROST SYSTEM AND METHODS

(71) Applicant: KEEPRITE REFRIGERATION, INC.

(72) Inventors: Yonghui Xu, Flower Mound, TX (US); Jacob Aaron Crane, Longview, TX (US)

(73) Assignee: KEEPRITE REFRIGERATION, INC., Longview, TX (US)

( * ) Notice: Subject to any disclaimer, the term of this patent is extended or adjusted under 35 U.S.C. 154(b) by 150 days.

(21) Appl. No.: 15/899,769

(22) Filed: Feb. 20, 2018

(65) Prior Publication Data

US 2018/0238598 A1 Aug. 23, 2018

Related U.S. Application Data

(60) Provisional application No. 62/460,468, filed on Feb. 17, 2017.

(51) Int. Cl.
*F25B 39/02* (2006.01)
*F25B 49/02* (2006.01)
(Continued)

(52) U.S. Cl.
CPC ..... *F25B 39/028* (2013.01); *F25B 47/025* (2013.01); *F25B 49/02* (2013.01); *F25B 2400/16* (2013.01); *F25B 2600/0251* (2013.01); *F25B 2600/2513* (2013.01); *F25B 2700/197* (2013.01); *F25B 2700/1931* (2013.01); *F25B 2700/21161* (2013.01);
(Continued)

(58) Field of Classification Search
CPC ..... F25B 47/025; F25B 2700/1931; F25B 39/028; F25B 49/02; F25B 2700/21161; F25B 2700/197; F25B 2600/0251; F25D 2321/1411
See application file for complete search history.

(56) References Cited

U.S. PATENT DOCUMENTS 2,554,848 A 5/1951 Warren
2,630,685 A 3/1953 Lewis
(Continued)

FOREIGN PATENT DOCUMENTS

CN 105387560 3/2016
GB 1355645 6/1974

*Primary Examiner* — Ana M Vazquez
(74) *Attorney, Agent, or Firm* — Sheridan Ross P.C.

(57) ABSTRACT

A method of defrosting an indoor coil in a refrigeration system in which, with a controller of the refrigeration system, a selected one of a number of predetermined defrost mode procedures is selected. Each predetermined defrost mode procedure is associated with a predetermined range of values of one or more predetermined parameters. Each predetermined defrost mode procedure includes adjustment of one or more components of the refrigeration system upon commencement of the defrost mode for optimum operation of the refrigeration system in the defrost mode, when the predetermined parameter is within the predetermined range of values upon commencement of operation in the defrost mode. With the controller, the component of the refrigeration system is adjusted in accordance with the selected one of the predetermined defrost mode procedures.

15 Claims, 9 Drawing Sheets

(51) Int. Cl.
*F25B 47/02* (2006.01)
*F25D 21/14* (2006.01)

(52) U.S. Cl.
CPC ..... *F25B 2700/21171* (2013.01); *F25B 2700/21175* (2013.01); *F25D 21/14* (2013.01); *F25D 2321/1411* (2013.01)

(56) References Cited

U.S. PATENT DOCUMENTS 2,762,206 A 9/1956 Ashley
3,167,930 A 2/1965 Block et al.
3,922,875 A 12/1975 Morris, Jr.
3,992,895 A 11/1976 Kramer
4,068,494 A 1/1978 Kramer
4,102,389 A * 7/1978 Wills ..... F25B 13/00 165/231
4,236,381 A 12/1980 Imral et al.
4,266,405 A 5/1981 Trask
4,291,542 A 9/1981 Sminge et al.
4,328,680 A 5/1982 Stamp, Jr. et al.
4,346,566 A 8/1982 McCarty et al.
4,419,866 A 12/1983 Howland
4,439,995 A 4/1984 McCarty
4,550,770 A 11/1985 Nussdorfer et al.
4,573,326 A 3/1986 Sulfstede et al.
4,748,818 A 6/1988 Satterness et al.
4,912,933 A 4/1990 Renken
5,056,324 A 10/1991 Haley
5,201,195 A 4/1993 Gavlak et al.
5,285,646 A 2/1994 TaeDuk
5,345,775 A 9/1994 Ridenour
5,415,006 A 5/1995 Renkin et al.
5,669,223 A 11/1997 Haley et al.
5,689,964 A 11/1997 Kawakita et al.
5,771,703 A 6/1998 Rajendran
5,867,998 A 2/1999 Guertin
6,467,284 B1 10/2002 Chen et al.
6,481,231 B2 11/2002 Vogel et al.
6,609,382 B2 8/2003 Vander Woude et al.
6,694,754 B1 2/2004 Schenk et al.
6,708,510 B2 3/2004 Sulc et al.
6,715,304 B1 4/2004 Wycoff
6,745,583 B2 6/2004 So et al.
7,111,472 B1 9/2006 Cloud
7,219,505 B2 5/2007 Weber et al.
7,461,515 B2 12/2008 Wellman
7,895,850 B2 3/2011 Kitsch
8,037,710 B2 10/2011 Wu et al.
8,695,369 B2 4/2014 Wu et al.
9,285,153 B2 3/2016 Contreras et al.
9,347,700 B2 5/2016 Bush
9,803,911 B2 10/2017 Qu et al.
2015/0184920 A1 7/2015 Vie et al.
2016/0223236 A1* 8/2016 Kimura ..... F24F 3/065
2017/0089603 A1 1/2017 Bentz et al.

* cited by examiner

REVERSE DEFROST SYSTEM AND METHODS

This application claims priority to U.S. Provisional Patent Application No. 62/460,468, filed on Feb. 17, 2017, which is hereby incorporated herein by reference in its entirety.

FIELD OF THE INVENTION

The present invention is a reverse cycle defrost refrigeration system, and methods of defrosting the refrigeration system.

BACKGROUND OF THE INVENTION

As is well known in the art, the indoor coil in a refrigeration system typically is required to be defrosted from time to time. Various devices and methods for defrosting are known.

As is also well known in the art, the more commonly known defrosting methods, electric defrost and off-cycle defrost, have certain limitations or disadvantages. Another known method, reverse cycle hot gas defrost, is less commonly used due to certain disadvantages, including, but not limited to, the following.

- In low ambient temperature conditions, the defrost capacity (as hereinafter defined) is too low, often resulting in a prolonged or incomplete defrost.
- In high ambient temperature conditions, the defrost capacity may be too high, which could cause thermal shock and/or steaming.
- In low ambient temperature conditions, there is a potential for flooding the compressor.
- In most existing systems utilizing reverse cycle defrost, a receiver is lacking, or the systems tend to include extensive piping and valves.
- Flow reversal frequently results in flooding the compressor.
- Reversing valve non-actuation upon flow reversal.

SUMMARY OF THE INVENTION

There is a need for a reverse defrost system, and methods of reverse defrost, that overcome or mitigate one or more of the disadvantages or defects of the prior art. Such disadvantages or defects are not necessarily included in those described above.

In its broad aspect, the invention provides a method of defrosting an indoor coil in a refrigeration system in which a refrigerant is circulatable in a first direction to transfer heat out of air in a controlled space when the system is operating in a refrigeration mode, and in which the refrigerant is circulatable in a second direction at least partially opposite to the first direction when the system is operating in a defrost mode. The method includes configuring a controller of the refrigeration system to select a selected one of a plurality of predetermined defrost mode procedures, each predetermined defrost mode procedure being associated with a predetermined range of values of one or more predetermined parameters. Each predetermined defrost mode procedure includes adjustment of at least one component of the refrigeration system upon commencement of the defrost mode for optimum operation of the refrigeration system in the defrost mode, when the predetermined parameter is within the predetermined range of values upon commencement of operation in the defrost mode. While the refrigeration system is operating in the refrigeration mode, with the controller, a defrost commencement time is determined, at which the refrigeration system is to commence operating in the defrost mode. Prior to the defrost commencement time, with the controller, data for the predetermined parameter is compared to the predetermined range of values therefor associated with each of the predetermined defrost mode procedures respectively. The selected one of the predetermined defrost mode procedures for which the data for said at least one predetermined parameter is within the predetermined range of values therefor is selected. With the controller, the component of the refrigeration system is adjusted in accordance with the selected one of the predetermined defrost mode procedures.

In another of its aspects, the invention provides a method of defrosting a refrigeration system that includes a four-way reversing valve. The reversing valve has a compressor input port through which a refrigerant is flowable toward a compressor of the refrigeration system and a compressor output port through which the refrigerant exiting the compressor is flowable, in which the refrigerant flows in a first direction through the refrigeration system when the system is operating in the refrigeration mode and the refrigerant flows in a second direction at least partially opposite to the first direction when the refrigeration system is operating in a defrost mode. The compressor is de-energized prior to the refrigeration system switching between operating in the refrigeration mode and operating in the defrost mode. The method includes, with a controller of the refrigeration system, monitoring (i) an input pressure exerted by the refrigerant entering the input port, and (ii) an output pressure exerted by the refrigerant exiting the output port, to determine a pressure differential between the input pressure and the output pressure. Upon the controller determining that the refrigeration system is to switch between operation in the refrigeration mode and operation in the defrost mode within a preselected time period, if the pressure differential is less than a predetermined minimum pressure differential threshold, the compressor is energized. Upon the pressure differential being equal to or greater than a predetermined maximum pressure differential threshold, actuating the reversing valve.

BRIEF DESCRIPTION OF THE DRAWINGS

The invention will be better understood with reference to the attached drawings, in which.

DETAILED DESCRIPTION

Figure 1:
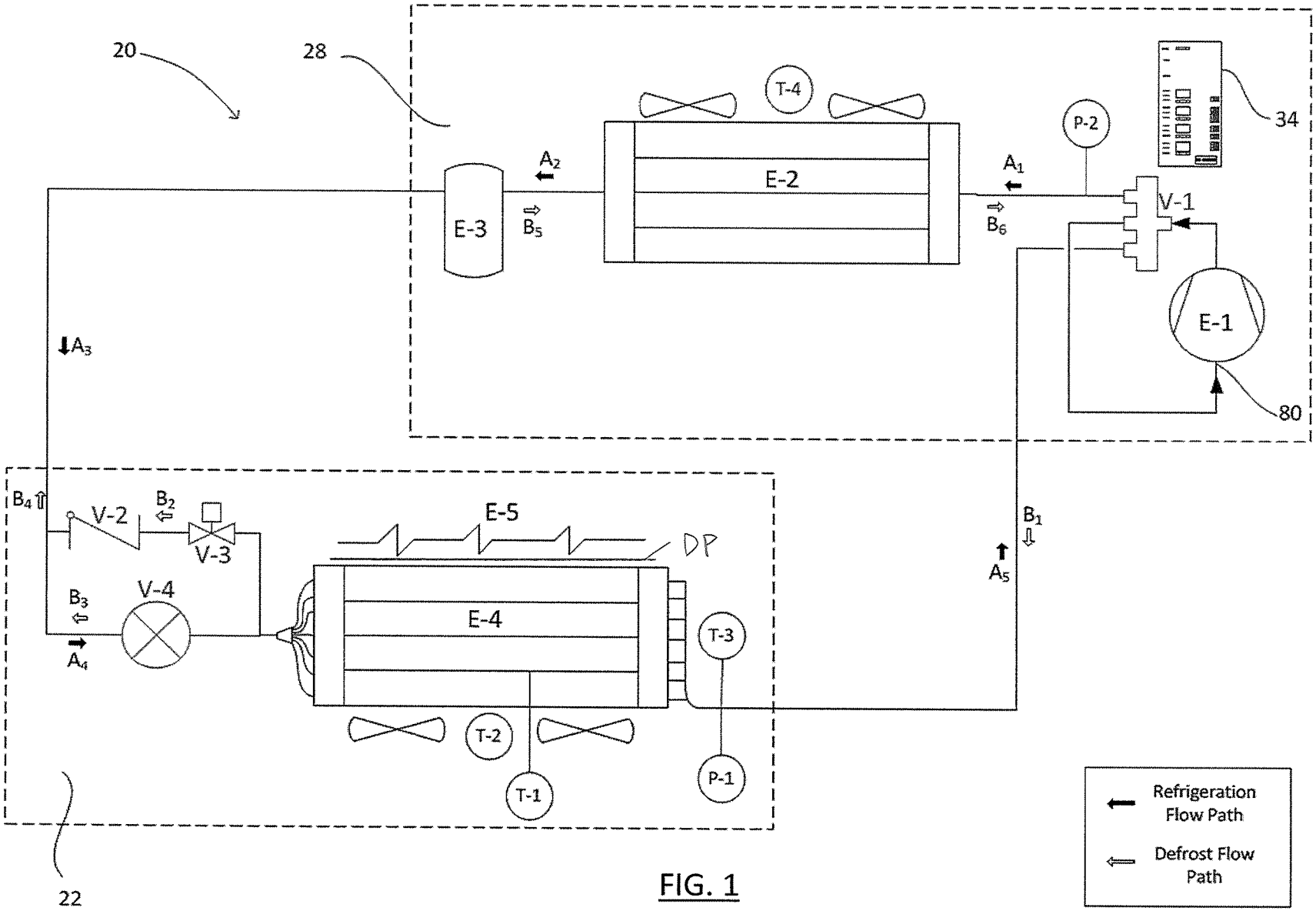
FIG. 1 is a schematic diagram of an embodiment of a system of the invention.

In the attached drawings, like reference numerals designate corresponding elements throughout. Reference is first made to FIG. 1 to describe an embodiment of a refrigeration system of the invention indicated generally by the numeral 20. In one embodiment, a refrigerant is circulatable in the refrigeration system 20 in a first direction (indicated by arrows "$A_1$"-"$A_5$" in FIG. 1) to transfer heat out of a volume of air in a controlled space 22 when the refrigeration system 20 is operating in a refrigeration mode, and in which the refrigerant is circulatable in a second direction (indicated by arrows "$B_1$"-"$B_6$" in FIG. 1) at least partially opposite to the first direction when the refrigeration system 20 is operating in a defrost mode. Preferably, the refrigeration system 20 includes a compressor E-1 for compressing the refrigerant to provide a superheated refrigerant vapor exerting a head pressure, and an outdoor coil E-2 for receiving the superheated refrigerant vapor and condensing the refrigerant therein, when the refrigeration system 20 is in the refrigeration mode. It is preferred that the outdoor coil E-2 is at least partially located in an uncontrolled space 28 in which air surrounding the outdoor coil E-2 is at an ambient temperature, as will be described.

Preferably, the refrigeration system 20 includes an indoor coil E-4 through which the refrigerant is circulatable, for heat transfer from the air in the controlled space 22 to the refrigerant, when the system 20 is in the refrigeration mode. Those skilled in the art would appreciate that the indoor coil E-4 may be positioned within or adjacent to the controlled (or refrigerated) space. The refrigerated space may be, for example, a cooler or freezer (walk-in or otherwise), or any other suitable defined space.

It is also preferred that the refrigeration system 20 includes an expansion valve V-4 positioned upstream from the indoor coil E-4 relative to the refrigerant flowing in the first direction. Those skilled in the art would be aware of suitable expansion valves. Preferably, the expansion valve is an electronic expansion valve. The expansion valve V-4 serves as the expansion device, when the refrigerant is flowing in the first direction, and provides pump down capabilities, as will also be described. The refrigeration system 20 also includes a bypass solenoid valve V-3 to permit the refrigerant to bypass the expansion valve V-4 when the refrigerant is flowing in the second direction, and a check valve V-2 to prevent the refrigerant from bypassing the expansion valve V-4 when flowing in the first direction.

Figure 8A:
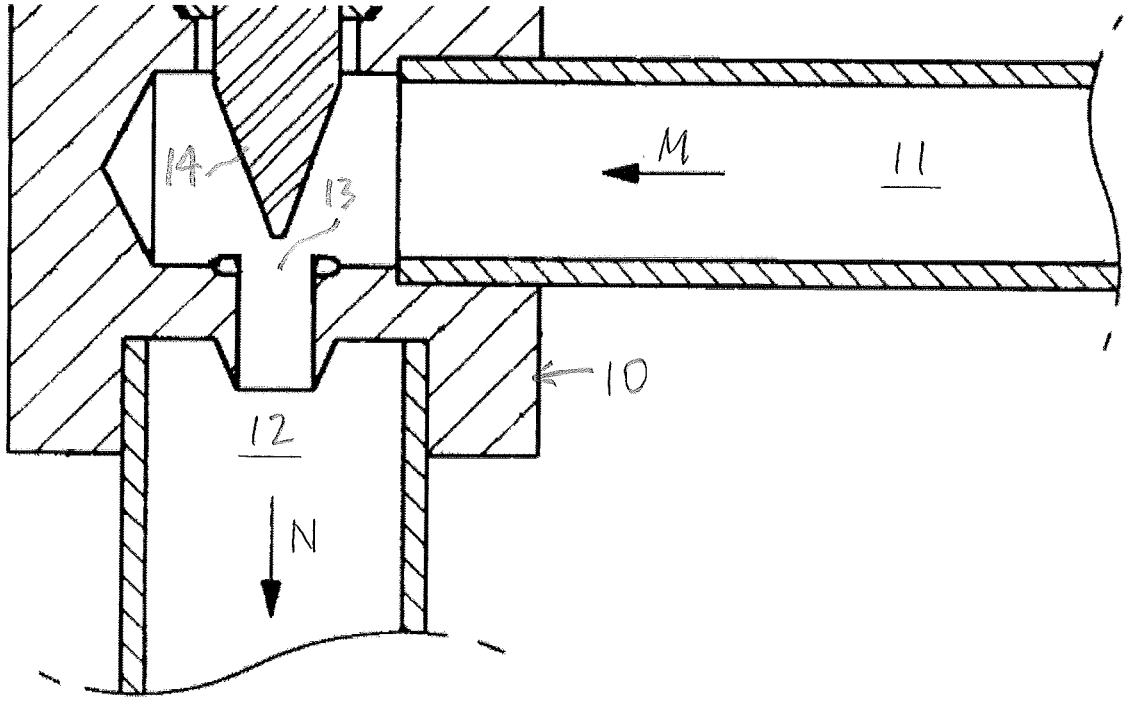
FIG. 8A is a cross-section of a part of an expansion valve, in an open condition.
Figure 8B:
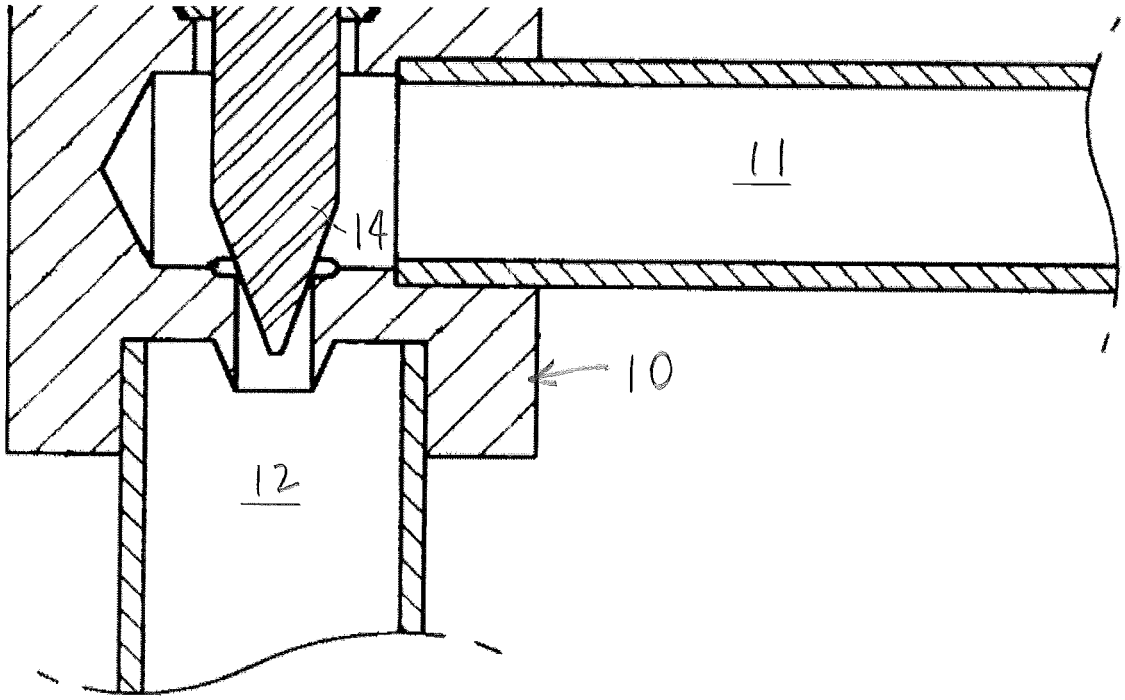
FIG. 8B is a cross-section of the part of the expansion valve of FIG. 8A, in a closed condition.

Those skilled in the art would appreciate that the expansion valve V-4 includes a valve body 10 in which first and second passages 11, 12 are defined, through which the refrigerant is flowable (FIGS. 8A, 8B). The first and second passages 11, 12 may be in fluid communication via an opening or orifice 13 (FIG. 8A). The opening 13 may be partially or fully closed by a valve needle 14, which is movable relative to the valve body 10. Those skilled in the art would be aware of various means for precisely controlling the positioning of the valve needle 14 relative to the orifice 13, to control the flow of the refrigerant through the passages 11, 12.

For example, the expansion valve V-4 may be electronically controlled. As illustrated in FIG. 8B, the valve needle 13 is positioned to block the opening 13, thereby preventing the refrigerant from flowing through the passages 11, 12. In FIG. 8A, the valve needle 14 is positioned to permit the refrigerant to flow through the passages 11, 12. The direction of flow of the refrigerant, when the refrigeration system is operating in the refrigeration mode, is indicated by arrows "M" and "N" in FIG. 8A.

Figure 2B:
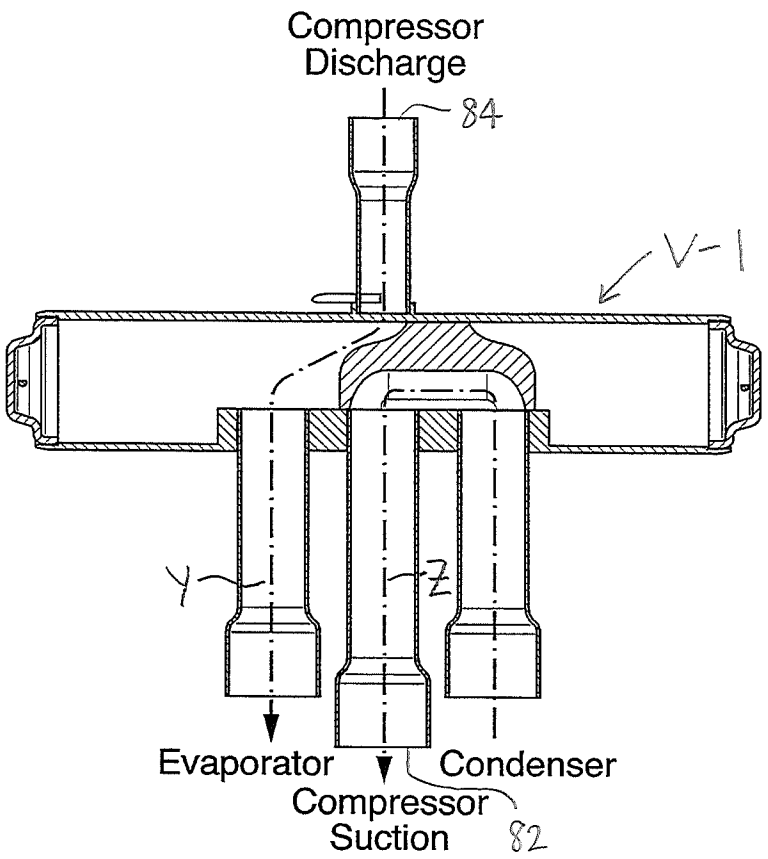
FIG. 2B is another cross-section of the four-way (reversing) valve of FIG. 1, showing paths taken by the refrigerant therethrough when the refrigeration system is in defrost mode.
Figure 2A:
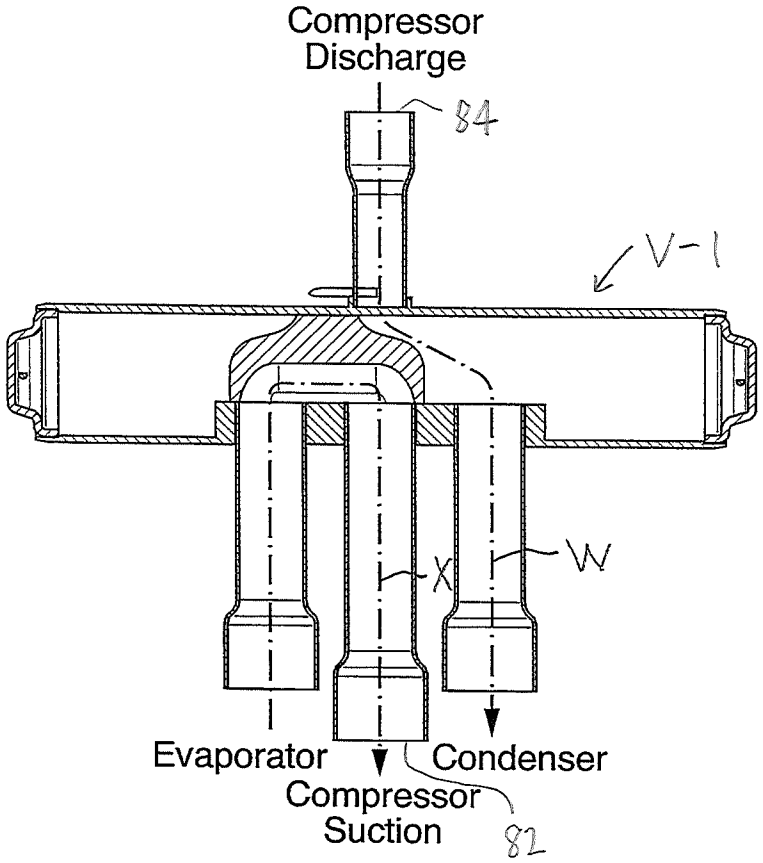
FIG. 2A is a cross-section of a four-way (reversing) valve of the refrigeration system of FIG. 1A showing paths taken by refrigerant therethrough when the refrigeration system is in refrigeration mode, drawn at a larger scale.

It is also preferred that the refrigeration system 20 includes a reversing valve V-1 (or flow diverting valve(s)). The operation of the reversing valve V-1 is known to those familiar with the art and is illustrated in FIGS. 2A and 2B. The functioning of the reversing valve V-1 when the refrigeration system is operating in the refrigeration mode is illustrated in FIG. 2A. In FIG. 2A, the refrigerant from the compressor E-1 flows through the valve V-1 to the outdoor coil E-2 (arrow "W"). The refrigerant exiting the indoor coil E-4 is directed to the intake of the compressor E-1 (arrow "X").

Similarly, the manner in which the valve V-1 functions when the refrigeration system 20 is in the defrost mode can be seen in FIG. 2B. In this mode, the refrigerant from the compressor discharge is directed to the indoor coil E-4 (arrow "Y"). The refrigerant exiting the outdoor coil E-2 is directed into the compressor E-1 (arrow "Z").

Typically, a drain pan "DP" is located underneath the indoor coil E-4, to collect condensate that condenses on exterior surfaces of the indoor coil. The condensate exits the drain pan via an opening therein (not shown). Preferably, the refrigeration system 20 includes a drain pan heater E-5 (FIG. 1) for warming the drain pan DP in order to prevent the condensate from re-freezing when it comes into contact with the drain pan, thus allowing the condensate to drain from the drain pan. As is known in the art, drain pan heaters come in many forms including, e.g., electric heating elements and hot vapor loops.

The system 20 preferably includes a controller 34 (FIG. 1). Those skilled in the art would be aware of a suitable controller. The controller 34 may be, for example, a suitable microcontroller, which may be preprogrammed, or more than one microcontroller, or a number of mechanical and/or electronic control devices. It will be understood that the controller 34 is operatively connected to and in communication with a number of components of the system 20, and that such connections are generally omitted from FIG. 1 for clarity of illustration. As will be described, the controller 34 receives data from the sensors, processes the data, and generally controls the components of the refrigeration system.

In one embodiment, the refrigeration system 20 additionally includes sensors, identified for convenience in FIG. 1 as P-1, P-2, T-1, T-2, T-3, and T-4. Those skilled in the art would be aware of suitable sensors. The number of sensors, and their respective locations in the refrigeration system, may vary from the arrangement illustrated in FIG. 1, which is exemplary only. The sensors P-1 and P-2 sense pressure exerted by the refrigerant at the locations respectively indicated in FIG. 1, and the sensors T-1 and T-3 detects the temperature of the refrigerant at the sensor's location. The sensor T-2 detects the temperature of the air in the controlled space. The sensor T-4 senses the ambient temperature of the air outdoors 28, as will be described.

In one embodiment, the system 20 preferably also includes a receiver E-3. As is known in the art, during operation of the refrigeration system in the refrigeration mode, a receiver typically functions as a storage vessel, holding an excess volume of the refrigerant that may not be required in circulation, depending on the ambient temperature. Those skilled in the art would appreciate that the receiver may also serve as a storage tank for off cycle mode and service purposes.

Figure 3A:
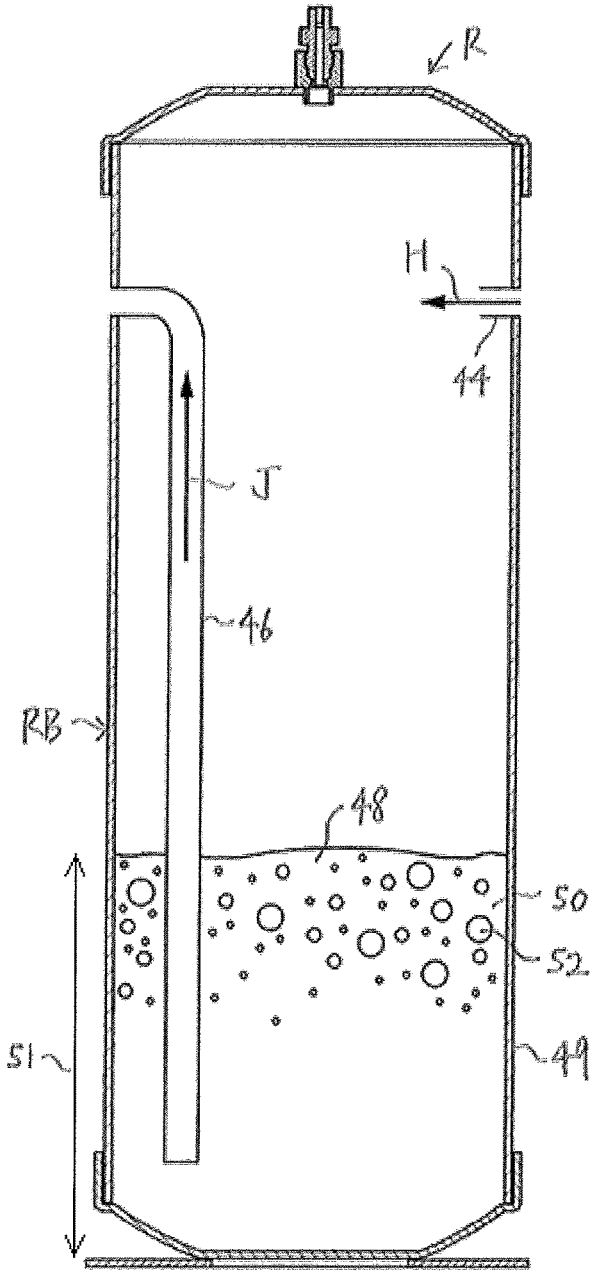
FIG. 3A (Prior Art)
FIG. 3A is a cross section of a receiver of the prior art.

A prior art receiver "R" is illustrated in FIG. 3A. As can be seen in FIG. 3A, the prior art receiver "R" that is designed for one-directional flow typically includes one inlet spout and one dip tube, identified in FIG. 3A by reference numerals 44, 46 respectively. For instance, during operation in the refrigeration mode, a refrigerant mixture 48 flows into the receiver body "RB" via the tube 44 (as indicated by arrow "H"), and the refrigerant mixture 48 collects in a lower region 49 of the receiver body "RB". The refrigerant mixture 48 includes both liquid refrigerant 50 and vapor refrigerant 52. The vapor refrigerant is present in the refrigerant mixture 48, in part, due to turbulence in the refrigerant entering the prior art receiver "R".

Because the mixture enters from the tube 44 and falls into the body from above, the amount of vapor bubbles 52 entrained in the mixture decreases with depth in the refrigerant column 51. The liquid refrigerant 50 is drawn upwardly (in the direction indicated by arrow "J") through tube 46, to exit the receiver "R" (FIG. 3A).

Those skilled in the art would appreciate that, when the system operates in the defrost mode, the refrigerant mixture 48 would flow into the receiver body "RB" via the tube 46 (i.e., in a direction opposite to the direction indicated by the arrow "J"), and only vapor would be able to exit the receiver "R" via the spout 44 (i.e., in a direction opposite to the direction indicated by the arrow "H"). In these circumstances, the defrost capacity of the refrigeration system would be drastically reduced. In short, as a practical matter, the prior art receiver "R" is not capable of allowing flow of liquid refrigerant in both directions therethrough.

Figure 3B:
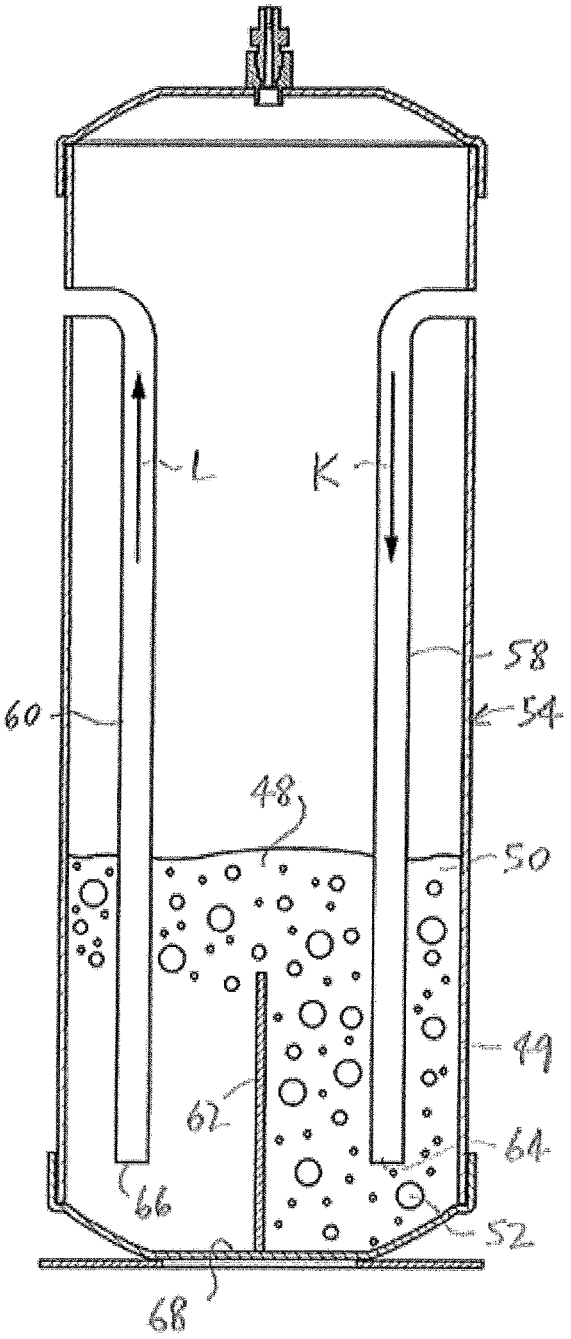
FIG. 3B is a cross-section of an embodiment of a receiver of the invention, with refrigerant therein, and an embodiment of a baffle element of the invention positioned therein.

An embodiment of a "bi-flow" capable receiver E-3 that is preferably included in the refrigeration system of the present invention is illustrated in FIG. 3B. It will be understood that the functions of the receiver E-3 are substantially identical regardless of flow direction. As can be seen in FIG. 3B, the receiver E-3 includes two dip tubes 58, 60, extending substantially to the bottom (or almost to the bottom) of the receiver body 54, and (as illustrated in FIG. 3B) into the refrigerant mixture 48. As can also be seen in FIG. 3B, it is also preferred that the receiver E-3 includes a baffle plate 62 positioned between the first and second tubes 58, 60 and extended substantially to the bottom 68 of the receiver body 54. The first and second dip tubes 58, 60 have respective ends 64, 66 thereof. A direction of flow of the refrigerant through the receiver is indicated by arrows "K" and "L" in FIG. 3B. It can be seen in FIG. 3B that, because the ends 64, 66 are immersed in the refrigerant collected at the bottom of the receiver body 54, the refrigerant may also flow through the receiver in the opposite direction.

The height of the baffle plate 62 is such that it would be submerged in the mixture 48 and substantially damp the turbulence from the incoming flow so that the refrigerant 48 on the opposite (downstream) side of the baffle plate 62 is generally unaffected by such turbulence. As will be described, in the less turbulent refrigerant, the refrigerant vapor tends to dissipate, and the refrigerant available on the downstream side of the baffle plate 62 has relatively fewer refrigerant vapor bubbles in it. As a result, the refrigerant exiting the receiver via the tube opening 66 is primarily liquid.

The first dip tube 58 is positioned so that its end 64 is immersed in the refrigerant 48, during operation of the system 20. The refrigerant entering the receiver E-3 is subject to relatively turbulent flow, resulting in the vapor bubbles 52 in the refrigerant mixture 48. As can be seen in FIG. 3B, in one embodiment, the baffle plate 62 preferably is positioned in the lower region 49 of the receiver body 54, substantially midway between the respective ends 64, 66 of the dip tubes 58, 60, and impedes the movement of vapor bubbles 52 entrained in the liquid refrigerant 50 below the baffle plate 62 and towards the end 66 of dip tube 60. Because of the baffle plate's position, movement of the vapor bubbles into the exiting refrigerant stream is impeded, regardless of whether the system is operating in the refrigeration mode or in the defrost mode.

Figure 3C:
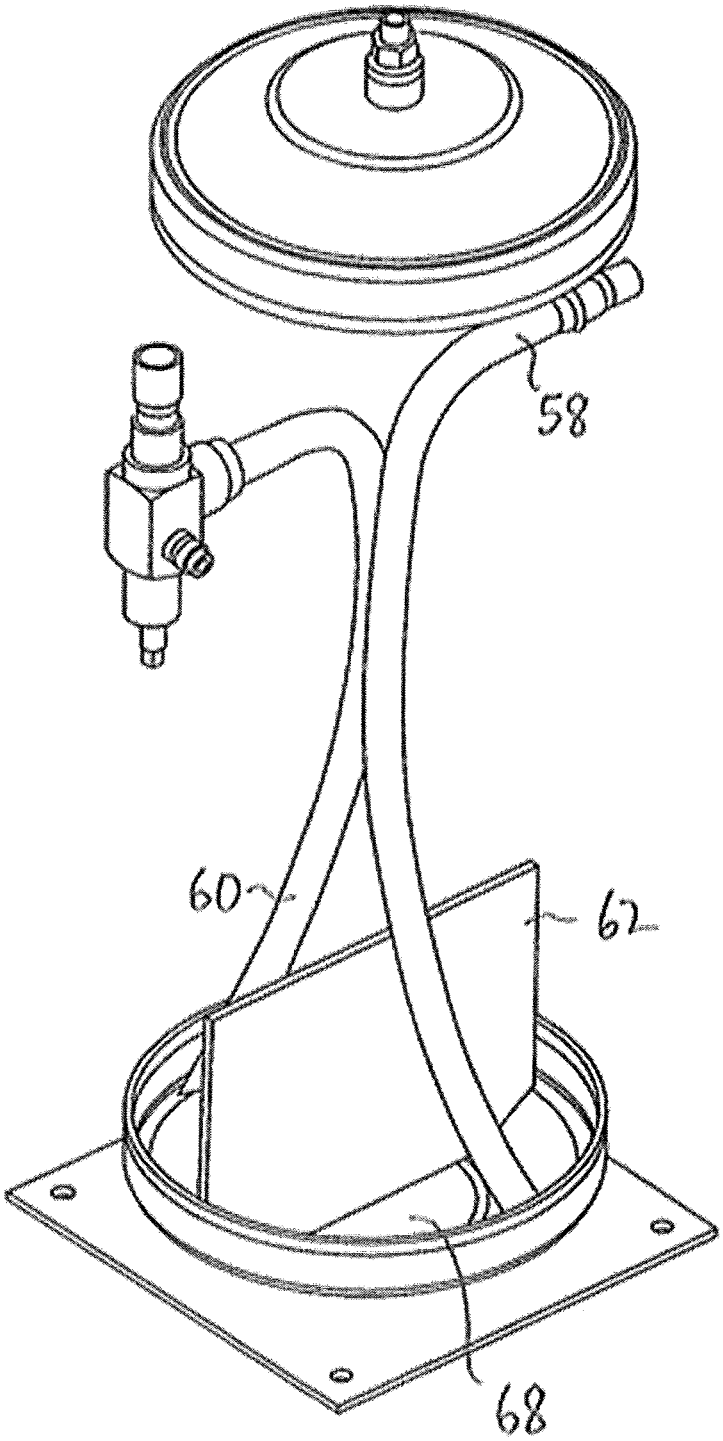
FIG. 3C is an isometric view of the receiver of FIG. 3B, with an outer shell component thereof omitted.

As illustrated in FIGS. 3B and 3C, in one embodiment, the baffle plate 62 preferably is a non-perforated plate. It will be understood that, alternatively, the baffle plate may take other forms (e.g., it may include perforations or louvers). In one embodiment, the baffle plate 62 preferably is mounted on a base plate 68 and positioned substantially vertically. As can be seen in FIGS. 3B and 3C, the base plate 68 preferably is an integral part of the receiver body 54.

Defrost Procedure Selection (Based on Ambient Conditions)

It is also preferred that the current invention employs a discharge pressure control method during refrigeration mode. Those skilled in the art would appreciate that the control of discharge pressure may be achieved by adjusting various components of the refrigeration system, or combinations thereof. In one embodiment, the controller 34 in FIG. 1 preferably is configured to control the speed of the outdoor coil fan based upon the discharge pressure, i.e., decreasing the speed to raise the pressure, and increasing the speed to lower the pressure, as needed to maintain the discharge pressure within a predetermined range.

As is well known to those skilled in the art, the performance and operating characteristics of a reverse cycle defrost system are significantly influenced by the ambient conditions to which the outdoor coil is exposed. Therefore, it is preferred that the refrigeration system is configured for operation in all possible ambient conditions.

A preferred feature of the current invention is the capability of the controller 34 to respond to the ambient conditions, based on one or more predetermined criteria, and data from the sensors. Suitable criteria are known among those skilled in the art, some examples include but are not limited to the following: ambient temperature, discharge pressure, condensing temperature, and liquid pressure.

Preferably, the controller has a unique response (hereafter referred to as a defrost mode procedure, or a defrost type routine) that is selected depending on whether then current ambient conditions are within a number of predetermined ambient condition ranges.

For example, if discharge pressure saturation temperature is being used as the ambient condition detection criteria, when the discharge pressure saturation temperature is less than 70° F., the controller would perform a routine for low ambient conditions. Also, if the discharge pressure saturation temperature is greater than or equal to 70° F. and less than or equal to 100° F. the controller would perform a routine for mild ambient conditions. Finally, if the discharge pressure saturation temperature is greater than 100° F. the controller would perform a routine for high ambient conditions.

Those skilled in the art would appreciate that the parameters outlined above are exemplary only. Any suitable parameters may be selected in association with any predetermined defrost mode procedures.

In one embodiment, the invention includes a method of defrosting the indoor coil in the refrigeration system in which the refrigerant is circulatable in the first direction to transfer heat out of air in the controlled space when the system is operating in the refrigeration mode, and in which the refrigerant is circulatable in the second direction at least partially opposite to the first direction when the system is operating in the defrost mode. Preferably, the method includes configuring the controller of the refrigeration system to select a selected one of a plurality of predetermined defrost mode procedures. Each predetermined defrost mode procedure is associated with a predetermined range of values of one or more predetermined parameters. Each predetermined defrost mode procedure includes adjustment of one or more components of the refrigeration system upon commencement of the defrost mode for optimum operation of the refrigeration system in the defrost mode, when the predetermined parameter is within the predetermined range of values upon commencement of operation in the defrost mode. While the refrigeration system is operating in the refrigeration mode, with the controller, a defrost commencement time is determined, at which the refrigeration system is to commence operating in the defrost mode. Prior to the defrost commencement time, with the controller, data for the predetermined parameter is compared to the predetermined range of values therefor associated with each predetermined defrost mode procedure respectively. The selected one of the predetermined defrost mode procedures is selected for which the data for the predetermined parameter is within the predetermined range of values therefor. With the controller, the one or more components of the refrigeration system is adjusted in accordance with the selected one of the predetermined defrost mode procedures.

Preferably, the adjustment of the one or more components includes adjustment of the opening 13 defined in the expansion valve V-4 in the refrigeration system through which the refrigerant is flowable by an initial proportion that is associated with the selected one of the predetermined defrost mode procedures.

Depending on the circumstances, at the commencement of operation in the defrost mode, the opening 13 may be fully closed, fully open, or partially open. Accordingly, when the selected one of the predetermined defrost mode procedure commences, the adjustment to the opening 13 may involve decreasing or increasing its size.

As noted above, the refrigeration system 20 includes the outdoor coil E-2, which is positioned outdoors and subject to ambient temperatures. In one embodiment, the predetermined parameter preferably is the ambient temperature.

However, in another embodiment, the predetermined parameter preferably is a discharge pressure of the refrigerant exiting the compressor E-1 in the refrigeration system 20, when operating in refrigeration mode.

Alternatively, in another embodiment, the predetermined parameter preferably is a pressure exerted by a refrigerant upon exiting an outdoor coil in the refrigeration system, when operating in the refrigeration mode.

In yet another embodiment, the predetermined parameter preferably is a temperature of the refrigerant in the outdoor coil during operation in the refrigeration mode.

Thermal Shock Prevention (Warm Liquid Injection)

During refrigeration mode and immediately prior to defrost mode, the pressure and the temperature of the indoor coil are generally very low. During the defrost cycle (and in particular, at the commencement of the defrost cycle) the temperature and pressure of incoming hot vapor refrigerant are generally relatively high. As is known in the art, the high differential in temperature and pressure can cause problems, such as thermal shock.

Thermal shock is a potentially damaging effect, with causes including but not limited to sudden, large, and/or frequent temperature and pressure changes in a solid material, and vapor propelled liquid slugs. Those skilled in the art would appreciate that thermal shock may result in different failure modes all of which may cause tubing failure and refrigerant leakage:

(a) material fatigue due to thermal expansion and contraction;

(b) component interference due to thermal expansion;

(c) component interference and/or fatigue caused by induced vibrations.

Accordingly, in order to minimize the risk of thermal shock, it is preferred that the magnitude of the temperature and or pressure differentials of the refrigerant, between the end of refrigeration mode and the beginning of defrost mode is reduced, as will be described.

With regards to the reverse cycle defrost, defrost capacity may be considered to be the thermal energy available for melting the frost from the fins and tubing associated with the indoor coil E-4. Defrost capacity also determines the rate of change of the temperature of the coil. It can be calculated by multiplying the mass flow rate of the refrigerant by the difference in the enthalpies of the refrigerant entering and leaving the indoor coil. Defrost capacity increases with ambient temperature, and can increase to a point where it can cause undesirable effects, such as thermal shock and steaming. In low ambient temperatures defrost capacity can decrease to a point where it is too low, and can cause undesirable effects such as prolonged or incomplete defrost.

In order to control the rate and magnitude of the temperature and pressure increase, a method of the invention referred to as "warm liquid injection" (WLI) has been developed, for use in connection with operating the system 20 in defrost mode.

Warm liquid injection may be included in one or more defrost type routines. In all cases it will be included in the defrost type associated with the highest ambient temperatures. The higher the ambient temperature, the higher available defrost capacity and hence the greater risk of thermal shock.

Figure 4:
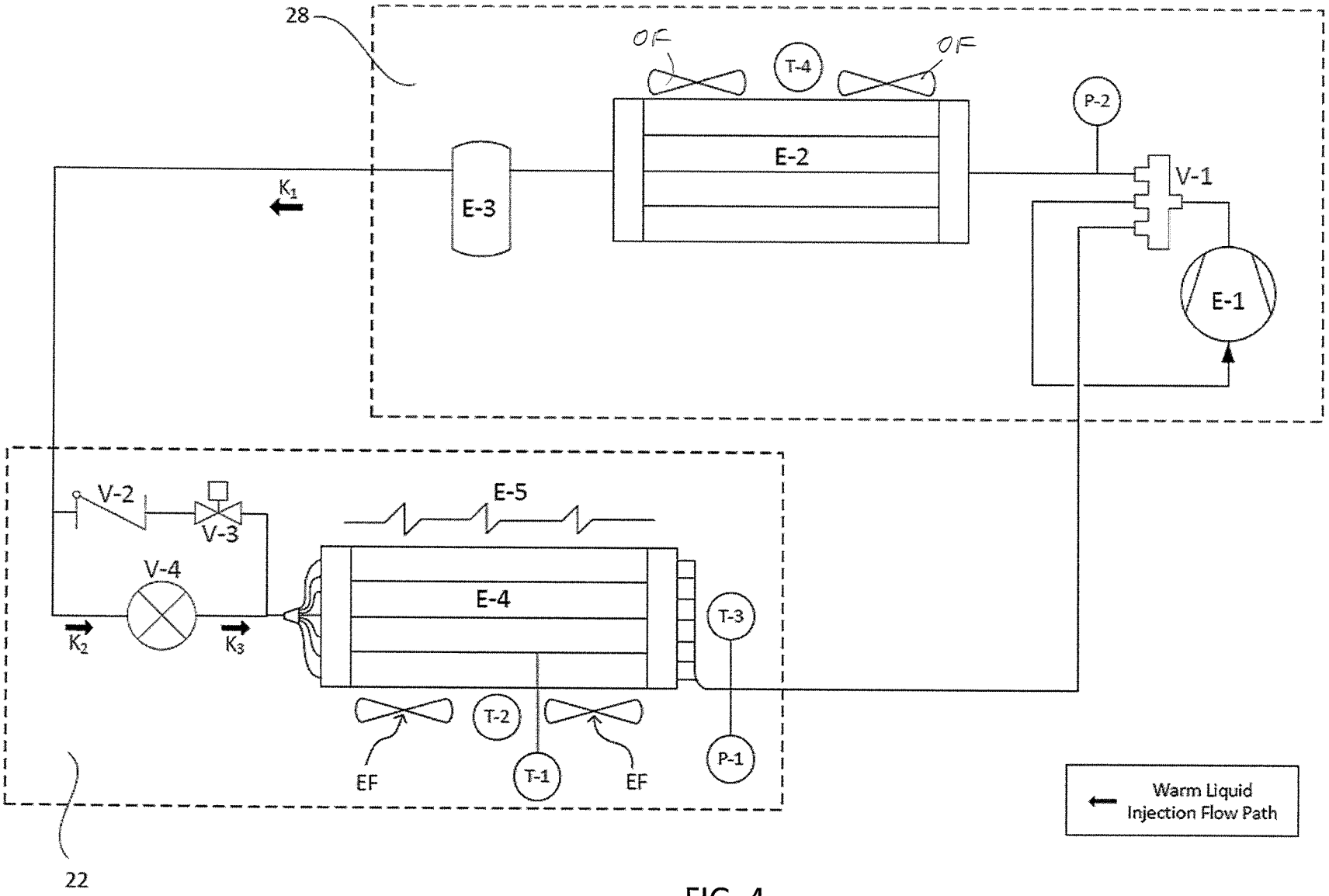
FIG. 4 is a schematic diagram of another embodiment of the system of the invention.

An embodiment of the invention for a method of warm liquid injection may be utilized with the refrigeration system schematically illustrated in FIG. 4. During warm liquid injection, the expansion valve V-4 is opened to 100% (i.e., the opening 13 is fully open), to permit warm refrigerant liquid to bleed into the indoor coil E-4, providing a lower initial defrost capacity. The warm liquid injection method is preferably performed with the compressor E-1 de-energized, but could also be performed while the compressor is energized. It is also preferred that the indoor coil fans "EF" are de-energized. It is also preferred that this method is terminated based on any suitable parameter, or parameters. For example, the warm liquid injection process may be terminated upon suitable pressure or temperature (or a combination thereof) being reached. Alternatively, the warm liquid injection process may be terminated at the end of a predetermined time period. It will be known by those skilled in the art that there are other valve and tubing configurations that would allow for warm liquid injection, other than the configuration illustrated in FIG. 4. Also, it will be understood that certain elements of the system illustrated in FIG. 4 have been omitted therefrom for clarity of illustration.

The flow of the warm liquid refrigerant to the indoor coil E-4 during warm liquid injection is schematically represented by arrows $K_1$-$K_3$ in FIG. 4.

Upon the termination of the warm liquid injection process, the compressor and reversing valve V-1 are energized to cause the refrigerant to flow in the second direction, i.e., operation in the defrost mode is initiated. During this time the indoor coil fan(s) "EF" remains de-energized, whereby the hot vapor refrigerant flows in the second direction into the indoor coil, to defrost the indoor coil.

Figure 5:
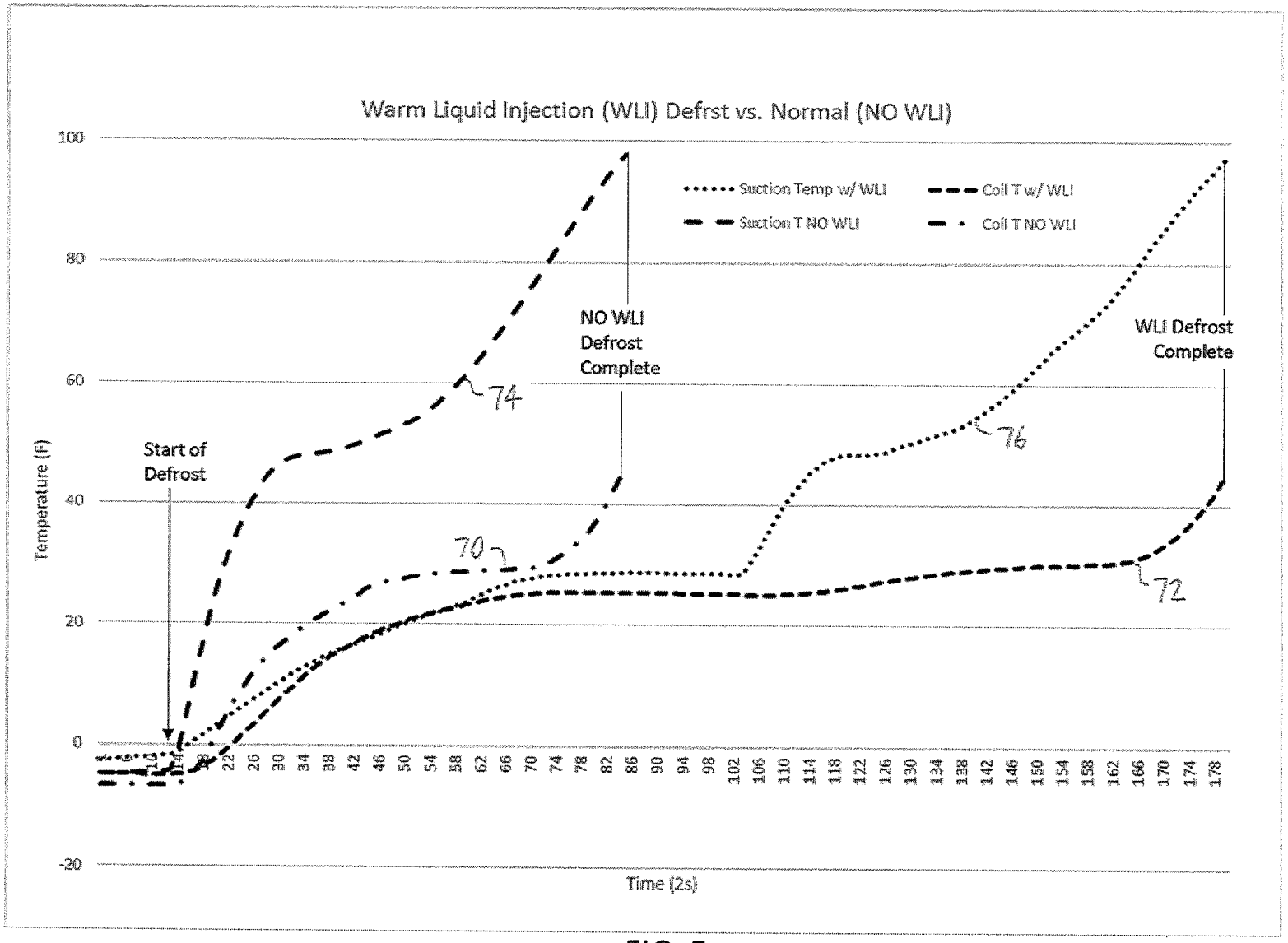
FIG. 5 is a graph showing the benefit of results of testing relating to an embodiment of the warm liquid injection method of the invention.

The temperature data displayed in FIG. 5 is from two tests, i.e., one in which WLI is utilized, and one in which WLI is not utilized. The data represented by lines 72 and 76 (referred to as involving WLI), is from the test utilizing the warm liquid injection method. The data represented by lines 70 and 74 (referred to as involving NO WLI), is from the test not utilizing the warm liquid injection method. "Suction" and "Coil" in FIG. 5 refer to the locations of the temperature sensors that provided the data. Suction temperature was sensed by a temperature sensor located on the suction manifold of the indoor coil, which is the inlet to the indoor coil during the reverse cycle. Coil temperature was sensed by a temperature sensor inserted into the fins in the bottom left corner of the indoor coil touching two tubes thereof.

The slope of the lines in FIG. 5 represents the rate of change of the temperature at the locations of the temperature sensors. It was found that the warm liquid injection method had a suction temperature rise of approximately 1.3° F. per second, and the method with no warm liquid injection had a suction temperature rise of approximately 4.5° F. per second. It can also be seen that using the warm liquid injection method increased the duration of defrost from approximately three minutes to six minutes, which correlates to a reduction of approximately half in average defrost capacity. From the foregoing, it can be seen that warm liquid injection is a successful method to reduce the risk of thermal shock.

Figure 6:
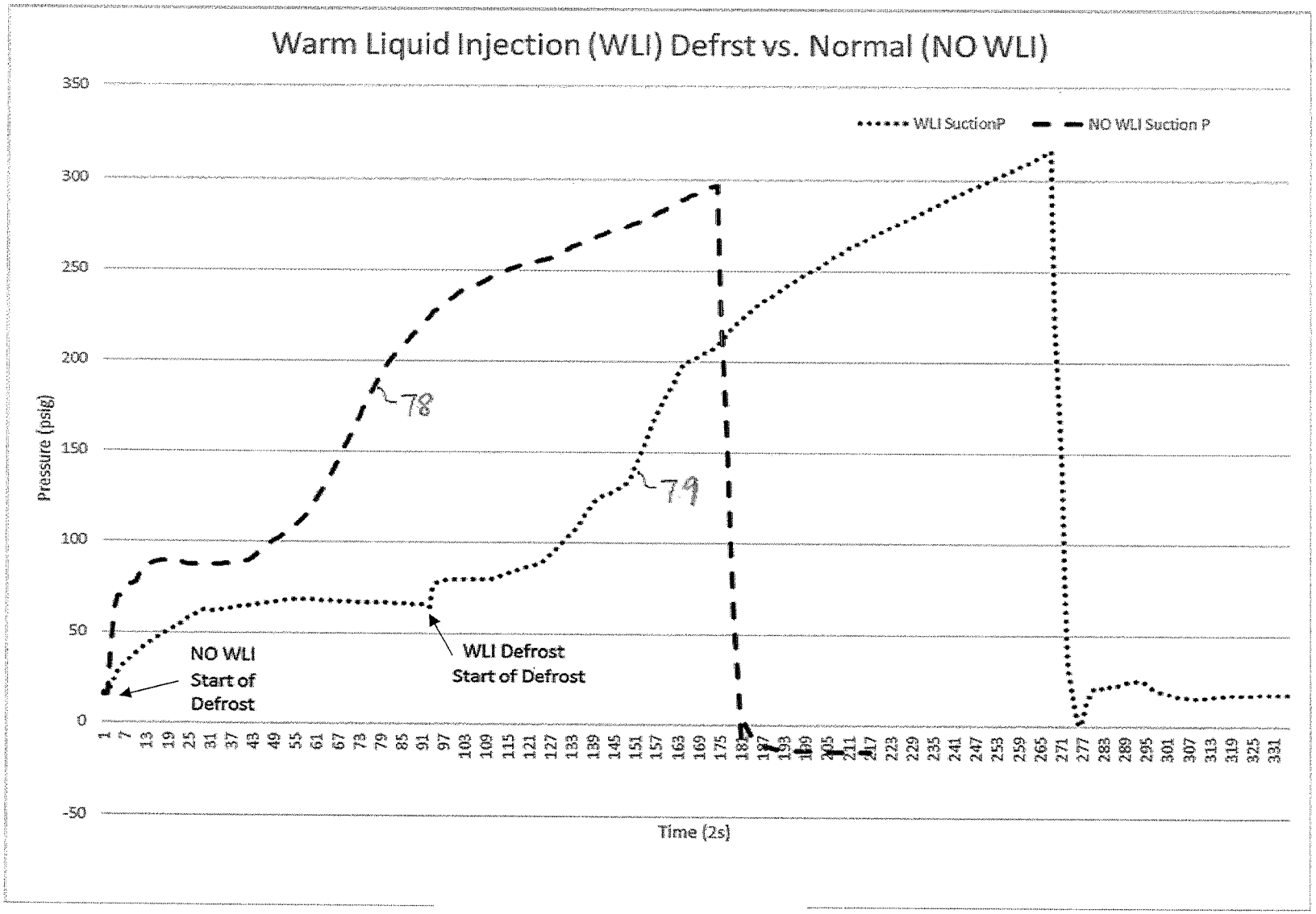
FIG. 6 is a graph showing the benefit of results of testing relating to another embodiment of the method of the invention.

The pressure data displayed in FIG. 6 is from the same two tests as the temperature data displayed in FIG. 5. The line 79 (referred to as involving WLI) is from the test utilizing the warm liquid injection method, the line 78 (referred to as involving NO WLI), is from the test not utilizing the warm the warm liquid injection method. Suction pressure refers to the pressure reading taken from inside the tube downstream and within one foot of the indoor coil in reference to the refrigerant flowing in the first direction.

It can be seen in FIG. 6 that the magnitude of the pressure spike at the beginning of the defrost immediately following warm liquid injection is much less than the corresponding pressure spike at the beginning of the defrost that was not immediately preceded by warm liquid injection. In the defrost preceded by warm liquid injection the suction pressure only increased 10 psi in the initial spike, whereas the defrost not involving warm liquid injection experienced a spike of roughly 60 psi. From the foregoing, it can be seen that warm liquid injection is a successful method to reduce the risk of thermal shock.

In one embodiment, the method of warm liquid injection process may be limited to a preselected time period. The method preferably includes, with the controller, determining at an initial time, based on predetermined criteria being met while the refrigeration system is operating in the refrigeration mode, that the refrigeration system is to commence operating in the defrost mode after a determined time period following the initial time. Upon the commencement of a preselected time period after the initial time, the following are de-energized: (i) the compressor of the refrigeration system, (ii) the outdoor coil fans OF of the refrigeration system, (iii) the defrost bypass valve of the refrigeration system, and (iv) the indoor coil fans EF of the refrigeration system. After the commencement of the preselected time period, the expansion valve of the refrigeration system is opened, to permit warm liquid refrigerant to flow into the indoor coil of the refrigeration system for the preselected time period, the preselected time period being sufficient to raise the temperature and pressure of the indoor coil to at least respective predetermined minimum defrost levels thereof. Upon the expiration of the preselected time period, the reversing valve V-1 of the refrigeration system is energized, to cause the refrigerant to flow in the second direction, to defrost the indoor coil.

The preselected time period is selected in order to provide warm liquid injection for a length of time sufficient to minimize the risk of thermal shock, in view of the ambient temperature.

In another embodiment, the warm liquid injection process ends when the temperature of the refrigerant in the indoor coil reaches a predetermined minimum defrost temperature. The method preferably includes, with the controller, determining at an initial time, based on predetermined criteria being met while the refrigeration system is operating in the refrigeration mode, that the refrigeration system is to commence operating in the defrost mode after a determined time period following the initial time. After the initial time, the following are de-energized: (i) the compressor of the refrigeration system, (ii) the outdoor coil fans OF of the refrigeration system, (iii) the defrost bypass valve of the refrigeration system, and (iv) the indoor coil fans EF of the refrigeration system. The expansion valve of the refrigeration system is opened, to permit warm liquid refrigerant to flow into the indoor coil of the refrigeration system until a temperature of the refrigerant in the indoor coil is raised to at least a predetermined minimum defrost temperature. Upon the temperature of the refrigerant in the indoor coil reaching the predetermined minimum defrost temperature, the reversing valve of the refrigeration system is energized, to cause the refrigerant to flow in the second direction, to defrost the indoor coil.

In another embodiment, the warm liquid injection process ends when the pressure of the refrigerant in the indoor coil reaches a predetermined minimum defrost pressure. The method preferably includes, with the controller, determining at an initial time, based on predetermined criteria being met while the refrigeration system is operating in the refrigeration mode, that the refrigeration system is to commence operating in the defrost mode after a determined time period following the initial time. After the initial time period, the following are de-energized: (i) the compressor of the refrigeration system, (ii) the outdoor coil fans OF of the refrigeration system, (iii) the defrost bypass valve of the refrigeration system, and (iv) the indoor coil fans EF of the refrigeration system. The expansion valve of the refrigeration system is opened, to permit warm liquid refrigerant to flow into the indoor coil of the refrigeration system until the pressure of the refrigerant in the indoor coil is raised to at least a predetermined minimum defrost pressure. Upon the pressure of the refrigerant in the indoor coil being raised to the predetermined minimum defrost pressure, the reversing valve of the refrigeration system is energized, to cause the refrigerant to flow in the second direction, to defrost the indoor coil.

Steaming Prevention (Drip Time Routine)

Coil steaming adversely affects the quality and safety of the cold storage (i.e., in the controlled space) by raising box temperature and causing frost or ice to collect on perishables stored in the space, as well as the surfaces of the refrigerated enclosure, creating a potentially unsafe work environment. To reduce the risk of coil steaming, the maximum temperature of the indoor coil preferably is limited. Those skilled in the art would be aware of other parameters that are useful steaming indicators (e.g., discharge temperature, suction manifold temperature, discharge pressure).

In order to minimize the risk of coil steaming, a method of monitoring the indoor coil temperature and preventing it from reaching a maximum threshold has been developed, for use in connection with operating the system 20 in defrost mode.

As is common in the art of defrosting refrigeration systems, the refrigeration system 20 preferably performs a drip time routine wherein, upon the completion of defrost mode, the refrigeration system postpones the resumption of refrigeration mode in order to allow melted frost to drain from the indoor coil for a predetermined amount of time. It will be understood from the description of this method that the drip time termination criteria may be any suitable criteria. Those skilled in the art would be aware of suitable criteria.

During the drip time routine, the indoor coil temperature preferably is high enough to prevent the melted frost from refreezing to the coil, but low enough to prevent steaming and significant room temperature rise. During drip time the refrigeration system continues to operate in defrost mode wherein the refrigerant is flowing in the second direction, allowing hot vapor refrigerant to enter the indoor coil, and warm the coil. Concurrently the coil temperature is being monitored via sensor T-1 by the controller 34 (FIG. 1). Upon detection of a maximum threshold temperature by sensor T-1, the controller de-energizes the compressor, and closes the defrost bypass valve V-3 and the expansion valve V-4 (FIG. 1).

This method allows the indoor coil to retain enough heat energy to prevent melted frost from re-freezing to the coil. It also prevents the coil from obtaining enough heat to cause steaming and significant room temperature rise. By closing the defrost bypass valve and the expansion valve the system also retains enough pressure differential to actuate the reversing valve upon drip time termination.

Accordingly, in one embodiment of the method of the invention, upon the completion of the defrost mode, the refrigeration system delays commencement of the refrigeration mode for a drip time period, to permit melted condensate to drip from the outdoor coil. During the drip time period, upon detection of a predetermined maximum temperature of the refrigerant in the indoor coil, the compressor of the refrigeration system is de-energized, and the defrost bypass valve V-3 of the refrigeration system and the expansion valve V-4 of the refrigeration system are closed. In this way, the temperature increase of the refrigerant in the indoor coil is limited.

Flood Back Protection (Reverse Pump Out)

Those skilled in the art would appreciate that, upon the system switching from the refrigeration mode to the defrost mode, the outdoor coil E-2 contains a substantial amount of liquid refrigerant, especially during low-temperature ambient conditions.

In the prior art, therefore, upon commencing the defrost mode, the liquid refrigerant is rerouted to the inlet 80 of the compressor E-1 (FIG. 1). In most cases (and in particular, during low-temperature ambient conditions), this causes flooding to the compressor at the beginning of the defrost mode.

In order to avoid these problems, in one embodiment (flood back protection via reverse pump out), the method of the invention preferably includes both of the expansion valve V-4 and the defrost bypass valve V-3 being closed at the same time, or at substantially the same time, as the refrigeration system commences operating in the defrost mode (i.e., upon reversing the direction of flow of the refrigerant).

Those skilled in the art would appreciate that, when the expansion valve V-4 and the defrost bypass valve V-3 are closed, and the refrigerant is flowing in the second direction, the pressure in the outdoor coil E-2 will drop into a range conducive for evaporating the refrigerant. It is preferred that the expansion valve V-4 and the defrost bypass valve V-3 remain closed for a period of time sufficient to allow the liquid refrigerant that is in the outdoor coil E-2 to evaporate. This reverse pump out process can be terminated based on any suitable parameter, e.g., compressor suction pressure (e.g., 15 to 25 psig), outdoor coil temperature, or a preselected time period.

Those skilled in the art would appreciate that the termination criteria may vary depending on a number of factors including, for instance, the refrigerant, the characteristics of the refrigeration system, and ambient conditions.

Preferably, the reverse pump out proceeds until one or more preselected parameters have reached one or more predetermined levels or amounts. For instance, one such preselected parameter may be a suction pressure, i.e., the reverse pump out is terminated when a specified suction pressure is achieved. Alternatively, the preselected parameter may be a predetermined time period.

Figure 7:
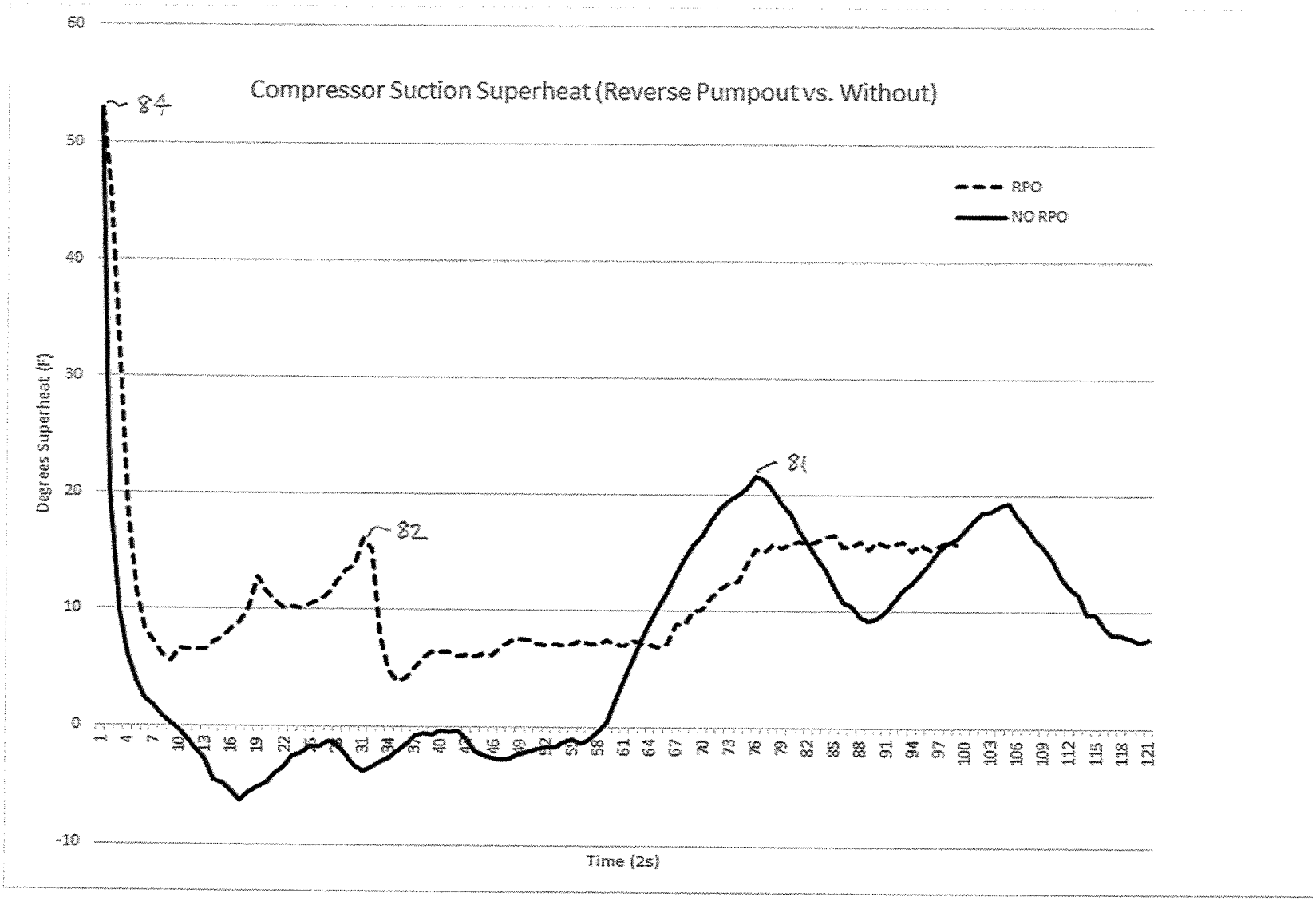
FIG. 7 is a graph showing results of testing additional embodiments of the method of the invention.

In FIG. 7, the results of two tests are represented, i.e., one with reverse pump out, and one without. The results of the test without reverse pump out are represented by line 81, and the results of the test with reverse pump out are represented by line 82. The point 84 represents the time at which the reversing valve V-1 is energized, reversing the flow direction and beginning the defrost mode. Flooding is represented by any lines in FIG. 8 that are below the horizontal (X) "0 axis". In FIG. 8, it can be seen that the test without reverse pump out resulted in flooding and low superheat during approximately the first two minutes of operation in the defrost mode. Based on these results, it shows that the test utilizing reverse pump out minimized flooding. This was confirmed during the test, by visual observation through a sight glass and elimination of audible elevated compressor noise.

The reverse pump out method may be used with alternative arrangements of elements. For example, a solenoid valve (e.g., valve V-3) may be located in the liquid line such that it would hold back refrigerant flowing in the second direction.

Accordingly, in one embodiment of the method of the invention, when the refrigeration system is operating in the refrigeration mode, the reversing valve of the refrigeration system is energized, to permit the refrigerant to flow in the second direction, to initiate operation of the refrigeration system in the defrost mode. Upon initiating operation of the refrigeration system in the defrost mode, the defrost bypass valve and the expansion valve of the refrigeration system are closed, until one or more preselected parameters are satisfied, whereupon the liquid refrigerant then in the outdoor coil substantially evaporates. Upon satisfying the one or more preselected parameters, the expansion valve is opened, to permit the refrigerant to flow therethrough while the refrigeration system is operating in the defrost mode.

Flood Back Protection (Pump Out)

Those skilled in the art would also appreciate that, upon the system switching from the defrost mode to the refrigeration mode, the indoor coil E-4 contains a substantial amount of high-pressure liquid refrigerant.

In the prior art, therefore, upon commencing the refrigeration mode, the liquid refrigerant is rerouted to the inlet 80 of the compressor E-1 (FIG. 1). In most cases this causes flooding to the compressor at the beginning of the refrigeration mode.

In order to avoid these problems, in one embodiment (flood back protection via pump out), the method of the invention preferably includes the expansion valve V-4 being closed at the same time, or at substantially the same time, as the system commences operating in the refrigeration mode (i.e., upon reversing the direction of flow of the refrigerant).

Those skilled in the art would appreciate that, when expansion valve V-4 is closed, and the refrigerant is flowing in the first direction, the pressure in the indoor coil E-4 will drop into a range conducive for evaporating the refrigerant. It is preferred that the expansion valve V-4 remains closed for a period of time sufficient to allow the liquid refrigerant that is in the indoor coil E-4 to evaporate. This reverse pump out process can be terminated based on any suitable parameter, e.g., compressor suction pressure (e.g., 0 to 5 psig), indoor coil temperature, or a preselected time period.

Accordingly, in one embodiment of the method of the invention, when the refrigeration system is operating in the defrost mode, the reversing valve of the refrigeration system is energized, to permit the refrigerant to flow in the first direction, to initiate operation of the refrigeration system in the refrigeration mode. Upon terminating the defrost mode by energizing the reversing valve to permit the refrigerant to flow in the first direction, the expansion valve V-4 of the refrigeration system is substantially simultaneously closed, to cause pressure in an indoor coil of the refrigeration system to drop, thereby facilitating evaporation of at least a portion of the refrigerant then in the indoor coil. Upon evaporation of substantially all of the refrigerant in the indoor coil, the expansion valve V-4 is opened, to permit the refrigeration system to operate in the refrigeration mode.

Controller Configured for Non-Actuation Protection (Based on Pressure Differentials)

In reverse cycle defrost systems utilizing four-way reversing valves, to at least partially reverse the refrigerant flow direction, it is important to maintain a sufficient pressure differential, between the discharge and suction pressures at either end of the reversing valve, in order to ensure complete actuation of the valve.

Four-way reversing valves rely on pressure differential between the tubes labeled "Compressor Discharge" and "Compressor Suction" in FIG. 2A and FIG. 2B. This pressure differential is the driving force in the actuation of the internal mechanisms of the reversing valve, and thus the pressure differential at the reversing valve is needed for the flow reversal in the system. (Because reversing valves are well known in the art, further description of the manner in which the reversing valve operates is unnecessary.) Attempting to actuate the reversing valve with too low of a pressure differential can result in a non-actuation or partial actuation, which can have detrimental effects on the refrigeration system and the items being refrigerated.

In order to prevent these problems, an embodiment of the method of the invention includes the controller 34 being configured for monitoring the pressures, postponing flow reversal and taking measures to increase the pressure differential if the pressure differential at the reversing valve is below a predetermined lower threshold.

The scenario where the pressure differential is below the lower threshold has only been observed in periods where the compressor is de-energized. For this reason, in routines that call for the compressor to be de-energized before actuation of the reversing valve, the controller 34 monitors the pressure differential. Preferably, within a relatively short preselected time period prior to the refrigeration system switching between operation in one of the refrigeration mode and the defrost mode and the other, the controller determines whether the pressure differential is below a minimum threshold. If, at the time the routine intends to actuate the reversing valve, the pressure differential is less than the lower threshold, then the compressor is re-energized until the pressure differential is approximately equal to a predetermined upper threshold. After the pressure differential reaches the upper threshold, the valve actuation will occur.

This method can be applied to any pneumatically actuated type valve dependent upon a pressure differential for actuation.

Accordingly, in one embodiment, the method of the invention preferably includes, with a controller of the refrigeration system, monitoring (i) an input pressure exerted by the refrigerant entering the input port 82, and (ii) an output pressure exerted by the refrigerant exiting the output port 84, to determine a pressure differential between the input pressure and the output pressure. Upon the controller 34 determining that the refrigeration system is to switch between operation in the refrigeration mode and operation in the defrost mode within a preselected time period, if the pressure differential is less than a predetermined minimum pressure differential threshold, the compressor is energized. Upon the pressure differential being equal to or greater than a predetermined maximum pressure differential threshold, the reversing valve is actuated.

Defrost Evaporation Control

Those skilled in the art will appreciate that there are problems associated with using standard refrigeration components and control methods to perform a reverse cycle defrost, especially in systems where the outdoor coil is subject to a wide range of varying ambient conditions. The problems include but are not limited to the following.

(a) Compressor suction superheating can be difficult to achieve without causing compressor starving, especially in low ambient temperatures.

(b) The condensing pressure is constantly increasing as the indoor coil warms and the frost melts.

(c) The refrigerant leaving the indoor coil and entering the expansion valve is not always pure liquid, especially at the beginning of defrost.

(d) The wide range of possible ambient conditions available to the outdoor coil creates evaporating pressures and temperatures beyond the operating envelope of most expansion valves.

(e) The wide range of possible ambient conditions available to the outdoor coil can cause undesirably high defrost capacity.

(f) The random and transient nature of the operating characteristics does not allow for reliably repeatable or steady conditions to be achieved, and common expansion devices cannot respond quickly enough to achieve desirable results.

Accordingly, in order to adapt the reverse cycle defrost system to its dynamic operating characteristics, a method referred to below as "defrost evaporation control" has been developed for use in connection with operating the system 20 in defrost mode.

Defrost evaporation control is a method of using the controller 34 to monitor preselected operating characteristics, and controlling preselected components of the system 20 in order to keep the preselected operating characteristics within a target range. This method works in conjunction with the defrost types noted above. As described above, each defrost type is associated with an ambient condition range and the defrost evaporation method adjusts the target range for the operating characteristics based upon which defrost type is occurring.

In one preferred embodiment of the defrost evaporation method the refrigeration system 20 employs a defrost bypass valve V-3 (FIG. 1). The defrost bypass valve is paired with a check valve V-2 in order to prevent refrigerant from bypassing the expansion valve V-4 during refrigeration mode. It can be seen that with this combination the defrost bypass valve V-3 can have no function during refrigeration mode. In defrost mode the valve V-3 is can be opened and closed in order to allow the refrigerant to at least partially bypass the expansion valve V-4. It will be known that there are other valve configurations that can perform the same functions as mentioned above, such as; replacing V-2 and V-3 with a bi-directional solenoid valve, replacing V-2 with another uni-directional solenoid valve, or replacing V-2 and V-3 with a proportional stepper type bypass valve. The preferred embodiments set forth in the examples above should not limit the scope of this invention.

In another aspect of this method, the defrost bypass valve V-4 is controlled by the controller 34 based on some predetermined criteria, in order to control said criterion within a target range, such as; any pressure measured downstream from the expansion valve, in reference to the refrigerant flowing in the second direction, and before the compressor. For example, the pressure measured by sensor P-2 (FIG. 1) when the system is operating in the defrost mode (i.e., the suction pressure) is a suitable criterion.

Those skilled in the art would appreciate that the defrost bypass valve V-3 affects the suction pressure (measured at sensor P-2) when the refrigerant is flowing in the second direction. Those skilled in the art would also be aware of many suitable control routines that can achieve the target pressure range, one such example being, the target pressure range for the suction pressure measured at sensor P-2 is 5 psig to 10 psig. While operating in defrost mode if the pressure measured at sensor P-2 falls below 5 psig the defrost bypass valve V-4 is opened, increasing the orifice size in the system and causing the pressure to rise. This in turn could cause the pressure measured at sensor P-2 to rise above 10 psig at which point the valve would be closed, reducing the orifice size in the system and causing the pressure to drop.

The target pressure range for controlling the defrost bypass valve can be selected based upon many different suitable criteria. Those skilled in the art will be aware of suitable criteria, for example, ambient temperature. The pressure range would be selected in order to maintain the vapor saturation temperature of the refrigerant in the outdoor coil, during defrost, at a level that provides sufficient temperature differential to provide heat transfer into the refrigerant and cause evaporation, while also subscribing to the compressor operating envelope.

In another embodiment of the invention the expansion valve V-4 has a predetermined initial percent opening based upon a predetermined criterion. Those skilled in the art will be aware of suitable criteria, for example, ambient temperature. The percent opening would be selected in order to provide a sufficient pressure drop to maintain the vapor saturation temperature of the refrigerant in the outdoor coil, during defrost, at a level that provides sufficient temperature differential to provide heat transfer into the refrigerant and cause evaporation.

A preferred embodiment of this invention, includes having an initial setting for the target pressure range of the suction pressure measured by sensor P-2 and an initial percent opening for the expansion valve V-4, based upon the defrost type. Following the example in paragraph 44, if the low ambient defrost type is selected than the initial target pressure range is 5-10 psig and the initial expansion valve percent open will be 20%, if the mild ambient defrost type is selected than the initial target pressure range is 15-20 psig and the initial expansion valve percent open will be 50%, if the high ambient defrost type is selected than the initial target pressure range is 25-30 psig and the initial expansion valve percent open will be 100%. These initial settings are exemplary only, and could change based on a number of suitable criterion including but not limited to; type of compressor, refrigerant, and outdoor fan speed.

In yet another preferred embodiment of this invention, the target pressure range (a selected suction pressure range) and expansion valve percent opening are adjustable in real time, as a response to a change in a predetermined criterion. The initial settings have been predetermined through testing but may not provide desired results in some cases, therefore a criterion has been selected to ensure desirable defrost performance. An example of a suitable criterion would be any temperature taken between the compressor discharge and the indoor coil inlet (the discharge temperature) in reference to the refrigerant flowing in the second direction.

In a preferred embodiment of the method of the invention, the temperature measured by sensor T-3 in FIG. 1 is used as the feedback criterion. When the compressor is flooding the discharged refrigerant tends to be saturated vapor or contain a fraction of liquid refrigerant. Because, during defrost the discharge vapor is rejecting its heat to melt frost (at 32° F.), the minimum acceptable liquid saturation temperature, of the refrigerant entering the indoor coil, is fairly predictable at around 40-45° F. Therefor if the temperature measured by sensor T-3 is below the set point (e.g. 45° F.) during defrost mode, it is a safe assumption that the compressor is flooding and there is liquid in the refrigerant entering the indoor coil. Those skilled in the art will appreciate that there is a predetermined time period at the beginning of defrost where the temperature measured by sensor T-3 will be below the predetermined set point while the associated tubing and sensor are being warmed, and in this period there will not be any adjustments made to the pressure range or valve percent opening.

In yet another embodiment of the invention, when the temperature measured by sensor T-3 is below 45° F. during defrost, the target pressure range (i.e., the selected pressure range) of the suction pressure measured at sensor P-2 and the expansion valve percent opening preferably are reduced. For example, if during a low ambient defrost type, wherein the initial target pressure range is 5-10 psig and the initial valve percent opening is 20%, the temperature measured by sensor T-3 falls below 45° F., the initial target pressure range upper threshold is reduced by half, and the valve percent opening is reduced by half. Therefore the target pressure range would equal 0-5 psig and the valve percent opening would equal 10%. It will be understood that the method set forth above is exemplary only.

In yet another aspect of the method of this invention, the outdoor fan speed is controllable by the controller 34 in order to mitigate the effects of the large range of ambient conditions the outdoor coil is exposed to. In one embodiment, during defrost the outdoor fan speed is preferably set based upon the defrost type, i.e., decreasing the speed with increasing ambient temperatures. For example, during a low ambient defrost type the outdoor fan speed is set to high speed, during a mild ambient defrost type the outdoor fan speed is set to low speed, and during a high ambient defrost type the outdoor fan speed is set to zero. Those skilled in the art would be aware of suitable fan motors and methods of control thereof that may be used.

Accordingly, in one embodiment, the method of the invention includes, during the defrost mode, with the controller, further adjusting one or more components and/or setpoints of the refrigeration system to maintain a suction pressure at an output end of the outdoor coil within a selected defrost mode suction pressure range in response to changes in a discharge temperature of the refrigerant at a discharge end of the indoor coil. The selected defrost mode suction pressure range preferably is defined by a defrost mode suction upper threshold pressure and a defrost mode suction lower threshold pressure.

In another embodiment, upon the discharge temperature, measured when the refrigeration system is operating in the defrost mode, falling below a defrost mode discharge temperature set point, the opening 13 in the expansion valve V-4 of the refrigeration system 20 is further reduced by a selected further proportion thereof, to decrease the suction pressure, and the selected defrost mode suction pressure range is further reduced commensurately.

In another embodiment, when the refrigeration system is operating in the defrost mode, upon the suction pressure falling below the defrost mode suction lower threshold pressure, the defrost bypass valve in the refrigeration system is opened, to increase the suction pressure until the suction pressure is within the selected defrost mode suction pressure range.

In yet another embodiment, when the refrigeration system is operating in the defrost mode, upon the suction pressure rising above the defrost mode suction upper threshold pressure, the defrost bypass valve in the refrigeration system is closed, to decrease the suction pressure until the suction pressure is within the selected defrost mode suction pressure range.

It will be appreciated by those skilled in the art that the invention can take many forms, and that such forms are within the scope of the invention as claimed. The scope of the claims should not be limited by the preferred embodiments set forth in the examples, but should be given the broadest interpretation consistent with the description as a whole.

We claim:

1. A method of defrosting an indoor coil in a refrigeration system in which a refrigerant is circulatable in a first direction to transfer heat out of air in a controlled space when the system is operating in a refrigeration mode, and in which the refrigerant is circulatable in a second direction at least partially opposite to the first direction when the system is operating in a defrost mode, the refrigeration system comprising an outdoor coil through which the refrigerant is circulatable, the outdoor coil being positioned outdoors and surrounded by air at an ambient temperature, the method comprising:

(a) configuring a controller of the refrigeration system to select a selected one of a plurality of predetermined defrost mode procedures, each said predetermined defrost mode procedure being associated with a predetermined range of values of at least one predetermined parameter, each said predetermined defrost mode procedure comprising adjustment of an opening defined in an expansion valve in the refrigeration system through which the refrigerant is flowable by an initial proportion that is associated with the selected one of said predetermined defrost mode procedures upon commencement of the defrost mode for optimum operation of the refrigeration system in the defrost mode, when said at least one predetermined parameter is within the predetermined range of values upon commencement of operation in the defrost mode;

(b) while the refrigeration system is operating in the refrigeration mode, with the controller, determining a defrost commencement time at which the refrigeration system is to commence operating in the defrost mode;

(c) prior to the defrost commencement time, with the controller, comparing data for said at least one predetermined parameter to the predetermined range of values therefor associated with each said predetermined defrost mode procedure respectively;

(d) selecting the selected one of said predetermined defrost mode procedures for which the data for said at least one predetermined parameter is within the predetermined range of values therefor; and (e) with the controller, adjusting the opening defined in the expansion valve of the refrigeration system in accordance with the selected one of said predetermined defrost mode procedures, wherein during the defrost mode, with the controller, the opening defined in the expansion valve of the refrigeration system is further adjusted to maintain a suction pressure at an output end of the outdoor coil within a selected defrost mode suction pressure range in response to changes in a discharge temperature of the refrigerant at a discharge end of the indoor coil, the selected defrost mode suction pressure range being defined by a defrost mode suction upper threshold pressure and a defrost mode suction lower threshold pressure.

2. The method according to claim 1 in which said at least one predetermined parameter is the ambient temperature.

3. The method according to claim 1 in which said at least one predetermined parameter is a discharge pressure of the refrigerant exiting a compressor in the refrigeration system.

4. The method according to claim 1 in which said at least one predetermined parameter is a pressure exerted by a refrigerant upon exiting the outdoor coil in the refrigeration system.

5. The method according to claim 1 in which said at least one predetermined parameter is a temperature of the refrigerant in the outdoor coil.

6. The method according to claim 1 in which, upon the discharge temperature, measured when the refrigeration system is operating in the defrost mode, falling below a defrost mode discharge temperature set point, the opening in the expansion valve of the refrigeration system is further reduced by a selected further proportion thereof, to decrease the suction pressure, and the selected defrost mode suction pressure range is further reduced.

7. The method according to claim 1 in which, when the refrigeration system is operating in the defrost mode, upon the suction pressure falling below the defrost mode suction lower threshold pressure, a defrost bypass valve in the refrigeration system is opened, to increase the suction pressure until the suction pressure is within the selected defrost mode suction pressure range.

8. The method according to claim 1 in which, when the refrigeration system is operating in the defrost mode, upon the suction pressure rising above the defrost mode suction upper threshold pressure, a defrost bypass valve in the refrigeration system is closed, to decrease the suction pressure until the suction pressure is within the selected defrost mode suction pressure range.

9. The method according to claim 1 additionally comprising the steps of:

with the controller, determining at an initial time, based on predetermined criteria being met while the refrigeration system is operating in the refrigeration mode, that the refrigeration system is to commence operating in the defrost mode after a determined time period following the initial time;

after the commencement of a preselected time period after the initial time, de-energizing (i) a compressor of the refrigeration system, (ii) outdoor coil fans of the refrigeration system, (iii) a defrost bypass valve of the refrigeration system, and (iv) indoor coil fans of the refrigeration system;

after the commencement of the preselected time period, opening the expansion valve of the refrigeration system to permit warm liquid refrigerant to flow into the indoor coil of the refrigeration system for the preselected time period, the preselected time period being sufficient to raise the temperature and pressure of the indoor coil to at least respective predetermined minimum defrost levels thereof; and upon the preselected time period expiring, energizing a reversing valve of the refrigeration system, to cause the refrigerant to flow in the second direction, to defrost the indoor coil.

10. The method according to claim 1 additionally comprising the steps of:

with the controller, determining at an initial time, based on predetermined criteria being met while the refrigeration system is operating in the refrigeration mode, that the refrigeration system is to commence operating in the defrost mode after a determined time period following the initial time;

after the initial time, de-energizing (i) a compressor of the refrigeration system, (ii) outdoor coil fans of the refrigeration system, (iii) a defrost bypass valve of the refrigeration system, and (iv) indoor coil fans of the refrigeration system;

opening the expansion valve of the refrigeration system to permit warm liquid refrigerant to flow into the indoor coil of the refrigeration system until a temperature of the refrigerant in the indoor coil is raised to at least a predetermined minimum defrost temperature; and upon the temperature of the refrigerant in the indoor coil reaching the predetermined minimum defrost temperature, energizing a reversing valve of the refrigeration system, to cause the refrigerant to flow in the second direction, to defrost the indoor coil.

11. The method according to claim 1 additionally comprising the steps of:

with the controller, determining at an initial time, based on predetermined criteria being met while the refrigeration system is operating in the refrigeration mode, that the refrigeration system is to commence operating in the defrost mode after a determined time period following the initial time;

after the initial time, de-energizing (i) a compressor of the refrigeration system, (ii) outdoor coil fans of the refrigeration system, (iii) a defrost bypass valve of the refrigeration system, and (iv) indoor coil fans of the refrigeration system;

opening the expansion valve of the refrigeration system to permit warm liquid refrigerant to flow into the indoor coil of the refrigeration system until pressure exerted by the refrigerant in the indoor coil is raised to at least a predetermined minimum defrost pressure; and upon the pressure of the refrigerant in the indoor coil being raised to the predetermined minimum defrost pressure, energizing a reversing valve of the refrigeration system, to cause the refrigerant to flow in the second direction, to defrost the indoor coil.

12. The method according to claim 1 in which:

upon the defrost mode having been completed, the refrigeration system delays commencement of the refrigeration mode for a drip time period, to permit melted condensate to drip from the outdoor coil; and during the drip time period, upon detection of a predetermined maximum temperature of the refrigerant in the indoor coil, a compressor of the refrigeration system is de-energized, and a defrost bypass valve of the refrigeration system and the expansion valve of the refrigeration system are closed.

13. The method according to claim 1 in which:

when the refrigeration system is operating in the refrigeration mode, a reversing valve of the refrigeration system is energized, to permit the refrigerant to flow in the second direction, to initiate operation of the refrigeration system in the defrost mode;

upon initiating operation of the refrigeration system in the defrost mode, a defrost bypass valve and the expansion valve of the refrigeration system are closed, until at least one preselected parameter is satisfied, whereupon the liquid refrigerant then in the outdoor coil substantially evaporates; and upon satisfying said at least one preselected parameter, the expansion valve is opened, to permit the refrigerant to flow therethrough while the refrigeration system is operating in the defrost mode.

14. The method according to claim 1 in which:

when the refrigeration system is operating in the defrost mode, a reversing valve of the refrigeration system is de-energized, to permit the refrigerant to flow in the first direction, to initiate operation of the refrigeration system in the refrigeration mode;

upon terminating the defrost mode by de-energizing the reversing valve to permit the refrigerant to flow in the first direction, the expansion valve of the refrigeration system is substantially simultaneously closed, to cause pressure in the indoor coil of the refrigeration system to drop, thereby facilitating evaporation of at least a portion of the refrigerant then in the indoor coil; and upon evaporation of substantially all of the refrigerant in the indoor coil, the expansion valve is opened, to permit the refrigeration system to operate in the refrigeration mode.

15. A method of defrosting a refrigeration system comprising a four-way reversing valve, the reversing valve having a compressor input port through which a refrigerant is flowable toward a compressor of the refrigeration system and a compressor output port through which the refrigerant exiting the compressor is flowable, in which the refrigerant flows in a first direction through the refrigeration system when the system is operating in the refrigeration mode and the refrigerant flows in a second direction at least partially opposite to the first direction when the refrigeration system is operating in a defrost mode, the compressor being de-energized prior to the refrigeration system switching between operating in the refrigeration mode and in the defrost mode, the method comprising:

(a) with a controller of the refrigeration system, monitoring (i) an input pressure exerted by the refrigerant entering the input port, and (ii) an output pressure exerted by the refrigerant exiting the output port, to determine a pressure differential between the input pressure and the output pressure;

(b) upon the controller determining that the refrigeration system is to switch between operation in the refrigeration mode and operation in the defrost mode within a preselected time period, if the pressure differential is less than a predetermined minimum pressure differential threshold, energizing the compressor; and (c) upon the pressure differential being equal to or greater than a predetermined maximum pressure differential threshold, actuating the reversing valve.

* * * * *